US008154377B2

(12) United States Patent
Lietz et al.

(10) Patent No.: US 8,154,377 B2
(45) Date of Patent: Apr. 10, 2012

(54) PASSIVE TRIGGERING OF A CIRCUIT BREAKER FOR ELECTRICAL SUPPLY LINES OF MOTOR VEHICLES

(75) Inventors: Franz-Josef Lietz, Oberhausen-Lirich (DE); Oliver Kastrop, Wetter (DE); Tomas Schulz, Unterensingen (DE); Reiner Mäckel, Königswinter (DE)

(73) Assignee: Auto Kabel Managementgesellschaft mbH, Hausen i.W. (DE)

( * ) Notice: Subject to any disclaimer, the term of this patent is extended or adjusted under 35 U.S.C. 154(b) by 146 days.

(21) Appl. No.: 11/910,588

(22) PCT Filed: Apr. 7, 2006

(86) PCT No.: PCT/EP2006/061460

§ 371 (c)(1),
(2), (4) Date: Dec. 6, 2007

(87) PCT Pub. No.: WO2006/077268

PCT Pub. Date: Jul. 27, 2006

(65) Prior Publication Data

US 2008/0204184 A1 Aug. 28, 2008

(30) Foreign Application Priority Data

Apr. 8, 2005 (EP) ..... 05007772

(51) Int. Cl.

| | |
|---|---|
| ***H01H 85/04*** | (2006.01) |
| ***H01H 37/76*** | (2006.01) |
| ***H01H 69/02*** | (2006.01) |
| ***H01H 9/00*** | (2006.01) |

(52) U.S. Cl. ..... 337/290; 337/401; 337/405; 337/413; 337/416; 29/623; 200/50.07

(58) Field of Classification Search ..... 337/290, 337/401, 405, 413, 416; 29/623; 200/50.07
See application file for complete search history.

(56) References Cited

U.S. PATENT DOCUMENTS 2,300,142 A * 10/1942 Wood ..... 337/164

(Continued)

FOREIGN PATENT DOCUMENTS

DE 19819662 11/1998

OTHER PUBLICATIONS

*International Search Report*, International Application No. PCT/EP2006/061460; Date of Mailing Jun. 16, 2006.

(Continued)

*Primary Examiner* — Bradley Thomas
(74) *Attorney, Agent, or Firm* — Sunstein Kann Murphy & Timbers LLP

(57) ABSTRACT

The invention relates to a circuit breaker for electrical supply lines, particularly power supply lines or battery cables, for motor vehicles, which circuit breaker is comprised of a first connecting element (1), a second connecting element (3) connectable to said first connecting element (1), and a current path whereby in the conducting state of the circuit breaker a current passes between the first connecting element (1) and the second connecting element (3).

Figure 1:
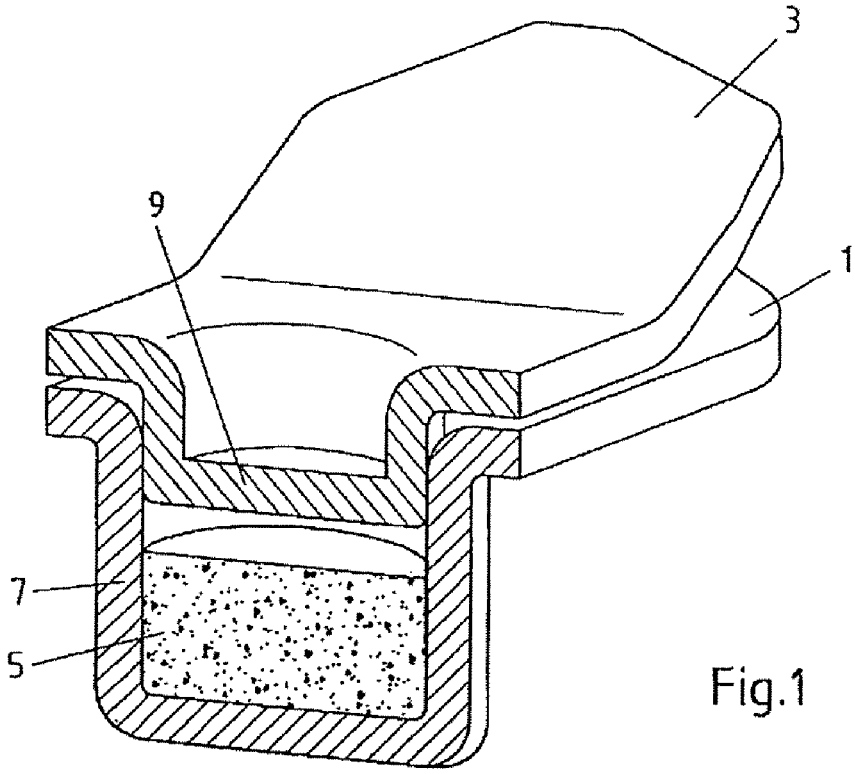

The technical problem of providing a circuit breaker for electrical supply lines which can be manufactured and advantageously ensures an error-free operation is solved in that a pyrotechnic separating unit (5) is thermally actuatable by Joule heat emitted by at least one of said connecting elements (1, 3) and in that, the connection between the connecting elements (1, 3) can be released by means of the actuated pyrotechnic separating unit (5).

22 Claims, 6 Drawing Sheets

U.S. PATENT DOCUMENTS 2,796,494 A * 6/1957 Barnes ..... 337/416
2,892,062 A * 6/1959 Wilhelm et al. ..... 337/290
2,921,167 A * 1/1960 Dahlen ..... 337/181
3,227,083 A * 1/1966 Moses et al. ..... 102/202.1
3,306,201 A * 2/1967 Noddin ..... 102/275.3
3,348,617 A * 10/1967 MaCartney ..... 169/42
3,475,572 A * 10/1969 Voyentzie et al. ..... 200/61.45 R
3,629,766 A * 12/1971 Gould, Jr. ..... 337/239
3,639,874 A * 2/1972 Deelman ..... 337/185
3,779,004 A * 12/1973 Gloeckler ..... 59/93
3,803,374 A * 4/1974 Delgendre et al. ..... 200/61.08
3,809,964 A * 5/1974 Ceyrat ..... 102/202.14
3,818,409 A * 6/1974 Pastors et al. ..... 337/273
3,848,100 A * 11/1974 Kozorezov et al. ..... 200/61.08
3,885,223 A * 5/1975 Green ..... 337/406
4,150,266 A * 4/1979 Patrichi ..... 200/61.08
4,224,487 A * 9/1980 Simonsen ..... 200/61.08
4,304,184 A * 12/1981 Jones ..... 102/202.13
4,311,890 A * 1/1982 Schroder ..... 200/61.08
4,345,127 A * 8/1982 Niemeyer ..... 218/43
4,370,531 A 1/1983 Tobin et al. ..... 218/117
4,385,216 A * 5/1983 Cinquin ..... 200/61.08
4,417,519 A * 11/1983 Lutz ..... 102/263
4,488,137 A * 12/1984 Rooney et al. ..... 337/162
5,120,152 A * 6/1992 Gueli ..... 403/179
5,319,344 A * 6/1994 Mosesian et al. ..... 337/244
5,535,842 A * 7/1996 Richter et al. ..... 180/279
5,631,620 A * 5/1997 Totsuka et al. ..... 337/260
5,686,878 A * 11/1997 Gueli ..... 337/416
5,756,928 A * 5/1998 Ito et al. ..... 149/7
5,783,987 A * 7/1998 Kern et al. ..... 337/401
5,793,275 A * 8/1998 Iversen ..... 337/273
5,929,739 A * 7/1999 Totsuka ..... 337/198
5,990,572 A * 11/1999 Yasukuni et al. ..... 307/10.1
6,194,988 B1 * 2/2001 Yamaguchi et al. ..... 337/157
6,243,245 B1 * 6/2001 Totsuka et al. ..... 361/103
6,272,992 B1 * 8/2001 Chatley, Jr. ..... 102/202.5
6,272,993 B1 * 8/2001 Cook et al. ..... 102/202.8
6,281,781 B1 * 8/2001 Yamaguchi ..... 337/401
6,357,355 B1 * 3/2002 Fogle, Jr. ..... 102/202.2
6,388,554 B1 * 5/2002 Yamaguchi ..... 337/401
6,404,322 B1 * 6/2002 Ruegsegger et al. ..... 337/416
6,411,190 B1 * 6/2002 Yamaguchi et al. ..... 337/401
6,448,884 B1 * 9/2002 Yamaguchi et al. ..... 337/401
6,483,420 B1 * 11/2002 Takahashi et al. ..... 337/401
6,487,972 B1 * 12/2002 Cook et al. ..... 102/202.8
6,598,532 B2 * 7/2003 Gerard et al. ..... 102/202.5
7,123,124 B2 * 10/2006 Caruso et al. ..... 337/157
7,239,225 B2 * 7/2007 Tirmizi ..... 337/30
7,498,531 B2 * 3/2009 Knauss et al. ..... 200/61.08
7,511,600 B2 * 3/2009 Von Behr et al. ..... 337/157
2001/0015883 A1 8/2001 Nakamura et al. ..... 361/170
2004/0041682 A1 * 3/2004 Pasha et al. ..... 337/401
2004/0113745 A1 * 6/2004 Lell et al. ..... 337/157
2005/0083164 A1 * 4/2005 Caruso et al. ..... 337/157

OTHER PUBLICATIONS

Abstract (English) of foreign patent document DE 19819662. Abstract provided by esp@cenet database—Worldwide.

* cited by examiner

PASSIVE TRIGGERING OF A CIRCUIT BREAKER FOR ELECTRICAL SUPPLY LINES OF MOTOR VEHICLES

The application relates generally to a circuit breaker for electrical supply lines, particularly power supply lines or battery cables, for motor vehicles, which circuit breaker is comprised of a first connecting element, a second connecting element connectable to said first connecting element, and a current path whereby in the conducting state of the circuit breaker a current passes between the first connecting element and the second connecting element.

Circuit breakers for motor vehicles have been long known. E.g., DE 19928713 A1 discloses a circuit breaker which has a meltable conductor. The meltable conductor is connected to a reaction container. After a chemical mixture present in the reaction container is ignited by an ignition mechanism, the reaction container is heated to the extent that the meltable conductor melts, thereby breaking the current path.

A further circuit breaker, for breaking at least two current paths, is disclosed in DE 10111254 A1. This device is intended to allow one current path to be broken while a second current path can remain active. By these means, one can provide redundant power supply to automotive systems which may be, e.g., important for safety purposes, and at the same time one can protect each current path against overload. For this purpose, each circuit breaker has at least three terminals, and is disposed near the relevant consuming device. One of the terminals serves for connecting to the consuming device, and the others for connecting to the circuits which are individually susceptible of being broken. If the current in a given circuit increases to a value above the maximum allowable current, that circuit is broken. The other circuits can continue to supply their associated consuming devices.

To break the current path, a certain cross section in a connecting element of the given circuit is broken. The breaking of the current path is accomplished with the aid of a chemical mixture which is disposed at the given cross section and when ignited breaks the cross section.

The known circuit breakers have various disadvantages. Elements of the circuit breaker are permanently damaged. In order to break the current path, costly elements are needed, to measure the current in the element where the circuit breaking is to occur, and to ignite the chemical mixture; thus the known circuit breakers are costly to manufacture.

In the light of the abovementioned disadvantages, the underlying problem of the present application was to devise a circuit breaker for electrical supply lines which has advantages regarding manufacturing and is completely reliable in operation.

This problem was solved according to the application in that on or at least one of the connecting elements a pyrotechnic separating unit is disposed which is thermally actuatable by Joule heat emitted by at least one of said connecting elements; and in that the connection between the connecting elements can be released by means of the actuated pyrotechnic separating unit.

The connection between the connecting elements can be provided by material bonding. For example, the second connection element can be connected to the first connectopn element by adhesive bonding. Adhesive bonding of the second connecting element to the first connecting element allows the second connecting element to have a simple geometry.

It is particularly preferred if the connecting elements are joined together by force closure means. This makes it particularly easy to ensure that the interconnection can be released by the pyrotechnic separating unit without damage.

The application recognizes that a pyrotechnic separating unit can be passively actuated by the temperature generated by the electric current flowing through the connecting elements. Each electrical resistance R generates a Joule heat Q which is proportional to the resistance R and the square of the current flowing through the resistance:

Q is proportional to $I^2$ R.

The temperature of the connecting elements is increased depending on the amount of heat produced. The resistance of the first and/or second connecting element can be adjusted such that, if a given current is sustained for a given time, a particular actuation temperature of the pyrotechnic separating unit will be reached. The circuit breaker is particularly distinguished in that it is compact and is inexpensive to manufacture.

E.g., the pyrotechnic separating unit can be designed to be actuated at a temperature between 160 and 195° C., particularly 170° C. It might be practical to employ such a pyrotechnic separating unit in conjunction with a circuit breaker having an operating temperature in long term operation of 100-125° C., particularly 115 ° C. Depending on the design of the pyrotechnic separating unit, other temperature levels may be realized. Via the relationship set forth above, there are relationships between the temperature, the current, and the duration of the current, for a given cross section of the elements. Making allowances for the lesser influence of external climatic conditions (which can be taken into account in the dimensioning of the system), one can use these relationships to adjust the system for the appropriate actuating current of the circuit breaker.

Candidates for use for the pyrotechnic separating unit include, e.g., mixtures disclosed in DE 20 2004 002292 U1. These mixtures are distinguished by high long-term stability. In principle, any mixture may be employed which can be thermally actuated, by addition of heat, and which can generate sufficient pressure to break the connection of the connecting elements held together by force closure. The pyrotechnic separating unit should be optimized to have a sufficiently high service life, particularly in terms of operating hours, e.g. for a motor vehicle a service life of 10 years or more.

According to a particularly preferred embodiment, at least the first connecting element has a first receptacle, which may serve to accommodate the pyrotechnic separating unit.

It is particularly easy and simple if the first receptacle is formed from (in or on) the first connecting element and is of unit construction therewith. The first receptacle may comprise a vessel structure which is formed in the first connecting element by drawing.

Alternatively, the first receptacle may be comprised of at least two receptacle elements. Thus, e.g., a first receptacle element may be formed in or one the first connecting element and may be of unit construction with the first connecting element; and a second receptacle element, e.g. in the form of a cylindrical piece, possibly closed on one end, may later be mounted on the first receptacle element. The pyrotechnic separating unit may be loaded into the second receptacle element in advance, provided that the method for attaching the second receptacle element to the first receptacle element does not cause heating up to the actuation temperature of the pyrotechnic separating unit. Examples of methods which might be used are friction welding, rotational friction welding, soldering, brazing, and adhesive bonding.

Additionally, a second receptacle may be provided, associated with the second connecting element, wherewith the pyrotechnic separating unit may disposed in the first or second receptacle or in both. A two-part pyrotechnic separating unit may be provided, with one part disposed in the first receptacle and the second part disposed in the second receptacle. Indeed, the existence of a "second receptacle" might not imply the existence of a first receptacle, but rather only one receptacle may be provided, in particular in or on the second connecting element.

In a preferred embodiment, the second connecting element may have a projection which corresponds to the first receptacle, such that in the conducting state of the circuit breaker the projection is forcibly (force closure) engaged in the first receptacle. In this way, the first receptacle can simultaneously perform the function of accommodating the pyrotechnic separating unit and forcibly engaging with the second connecting element. Alternatively, separate receptacles may be provided for the pyrotechnic separating unit and the forcible engagement. Other means of forcibly engaging the connecting elements are also within the scope of the invention.

Just as the first receptacle may be comprised of a plurality of receptacle elements, analogously the projection may be comprised of two or more projection elements. At least one of the projection elements (e.g. first or second) may have a second receptacle or second receptacle element.

The Joule heat produced by the current is influenced by all parameters which affect the resistance of a connecting element, e.g. the conductive cross section, the length, and the specific resistivity of the material. Thus, e.g., the first and/or second connecting element may be provided with a notch or the like which increases the ohmic resistance. One or more such notches on one or both of the connecting elements will reduce the electrically conducting cross section, thereby increasing the ohmic resistance, which will cause greater heat production for a given current. This provides a simple and inexpensive means of adjusting the resistance of the connecting elements. Also the cross sections of the connecting cables can influence the heat delivered.

Alternatively, e.g., the various parts of a multi-part receptacle and/or a multi-part projection may be fabricated from different materials having different resistivities, chosen to provide the appropriate resistances for actuating the pyrotechnic separating unit.

If necessary, the resistance can be reduced, by increasing the cross section. Also, the resistance can be influenced by various press-formed cross sections of elements.

In particular, the circuit breaker may be dimensioned such that the actuating current needed to reach the actuating temperature of the pyrotechnic separating unit by generation of Joule heat is less than or equal to the maximum allowable current in the lines and/or cables and/or consuming devices connected to the connecting elements. E.g., the maximum allowable current may be a current which is just below a current which, if sustained would lead to damage to or melting of the connecting cable and/or of the cable insulation.

According to a preferred embodiment, the first and/or second connecting element is comprised of a flat piece. This enables particularly economical manufacture of the circuit breaker.

The flat pieces are easily deformable, wherewith one can inexpensively produce in the connecting elements a first receptacle, a second receptacle, if needed, and a projection. The first connecting element and second connecting element can be mechanically interconnected via force closure, establishing a current path. The force needed to release this connection depends on the configuration of the first receptacle and of the projection. Preferably, the projection is lodged in the first receptacle by means of press-fitting, with a direct pressure connection between the projection and the first receptacle. In particular, a conical press fit is preferred, for which the first receptacle and/or the projection may be tapered. Preferably the tapered structure tapers with progression away from the respective flat piece.

It is particularly advantageous in the formation of the connecting elements if at least one of flat pieces is fabricated from a metallic (or other conductive) sheet or plate. Sheets and plates of a wide range of thicknesses, of electrically conductive materials, are suitable and are easy to fabricate and process. Extruded strip materials may also be used for fabrication of the flat pieces.

It is preferable if the sheets or plates of the flat pieces are formed by separating processes. Suitable such processes may include stamping, laser cutting, sawing, and other stress-free or stress-inducing cutting or press-forming processes.

The first receptacle can be formed from the respective connecting element by deep drawing or stamping (the latter particularly in the case of a two-element first receptacle).

In the event that the first receptacle is comprised of two receptacle elements, the first receptacle element may comprise a collar, e.g. formed by stamping out said first receptacle element from the connecting element. The collar may be shaped (or further shaped) by introduction of a mandrel into the stamped-out configuration. The second receptacle element can then be connected to the collar, by a method such as rotational friction welding, adhesive bonding, or another means, preferably a material bonding or force closure.

Alternatively, the first receptacle element and/or projection element may be formed solely from the area in the region of a stamping-out in the first or second connecting element, to which the second receptacle element and/or projection element is/are connected.

It is particularly advantageous for the manufacture of the circuit breaker if the projection is formed in or on the flat piece and is of unit construction therewith. Preferably this forming is by means of drawing, e.g. by stretch-drawing or deep drawing, or by bending. A stamp or press die can be guided into the flat piece to form the projection. It is also possible to provide the projection by mounting the projection structure onto the flat piece by means material bonding or force closure.

It is preferable if the projection is in the form of a deep-drawn vessel structure which corresponds to the receptacle. In a particularly inexpensive and rapid method of fabrication of the circuit breaker, which method is particularly preferred, the projection is formed from the flat piece of the first connecting element by drawing at the time when the first and second connecting elements are being interengaged. For this, e.g., the second connecting element may be disposed over the first connecting element and the projection can be formed by a press die which serves to form the projection and to force it (drive it) into the first receptacle, in order to interengage the connecting elements.

A further object of the present application is a method of breaking a circuit, particularly via a circuit breaker according to one or a combination of the above-described embodiments, wherein:

- an actuating current is passed through a circuit breaker;
- the first connecting element and/or second connecting element is heated to the actuating temperature by Joule heating;
- the pyrotechnic separating unit is actuated by the actuating temperature; and
- the connection of the connecting elements is released, and thereby the current path is broken, by means of the actuated pyrotechnic separating unit, wherewith preferably the release does not involve damage the connectopn elements.

The application will be described in more detail hereinbelow with reference to the accompanying drawings, which drawings illustrate an exemplary embodiment.

Figure 2:
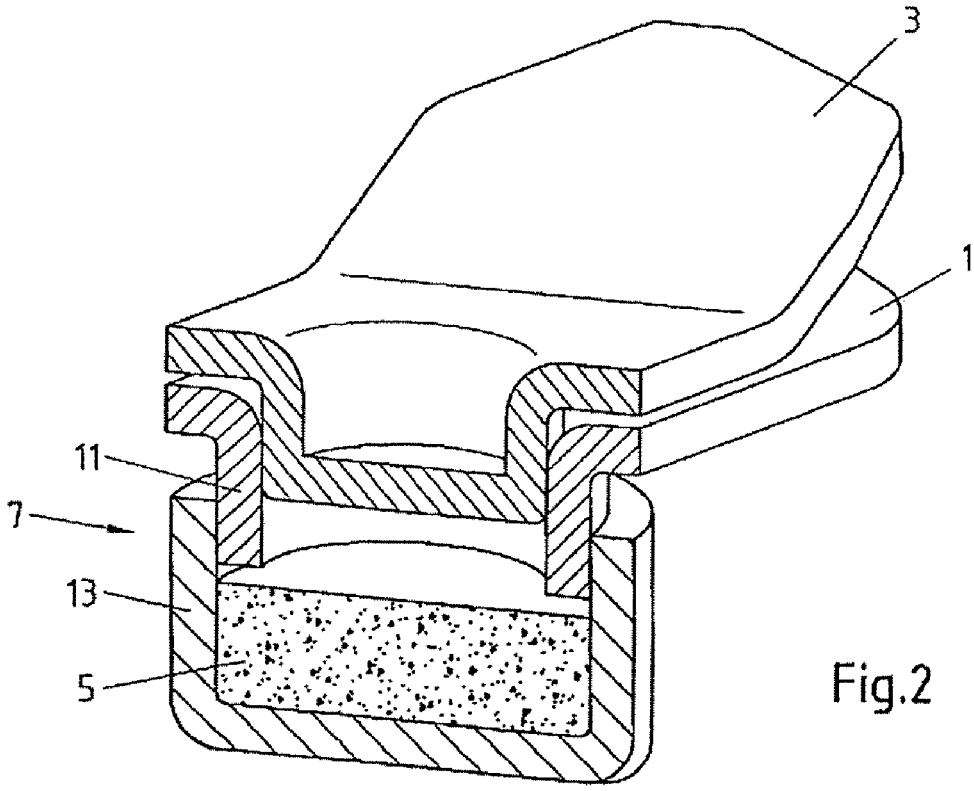
Figure 3:
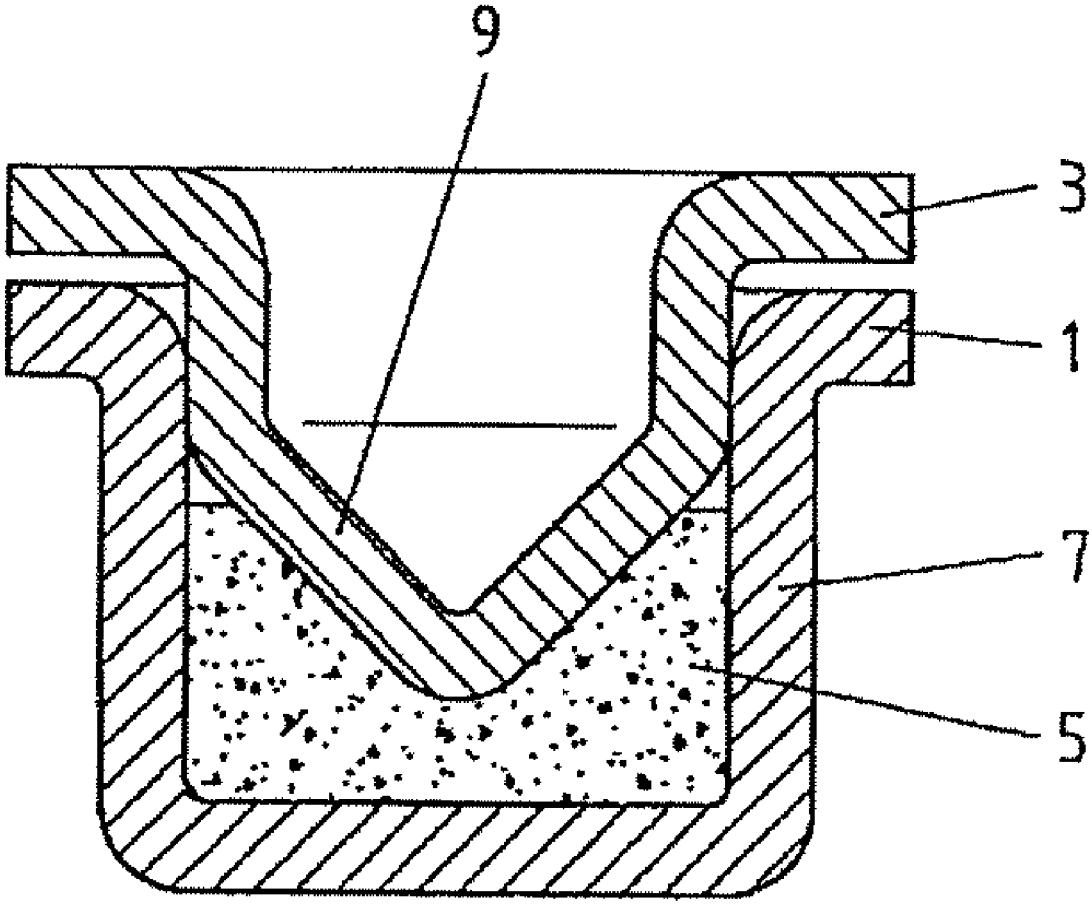
Figure 4:
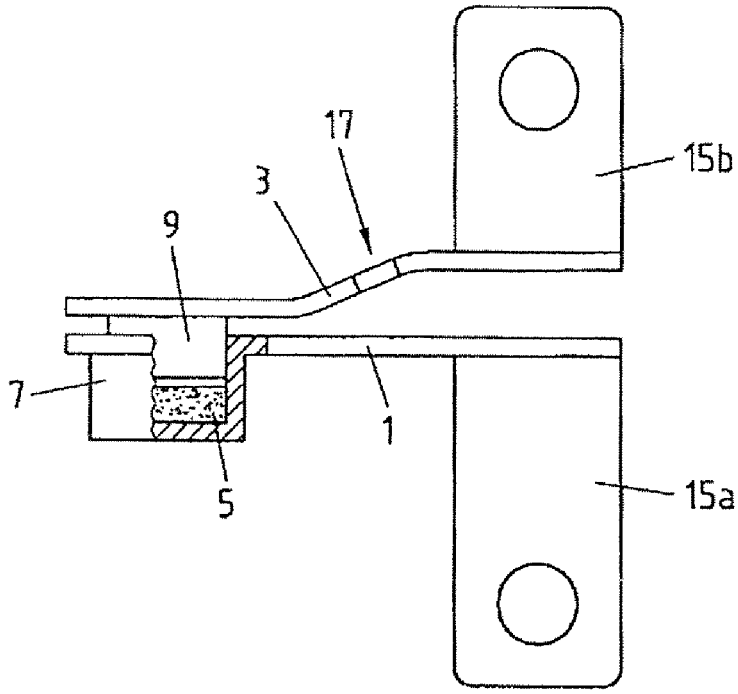
Figure 5:
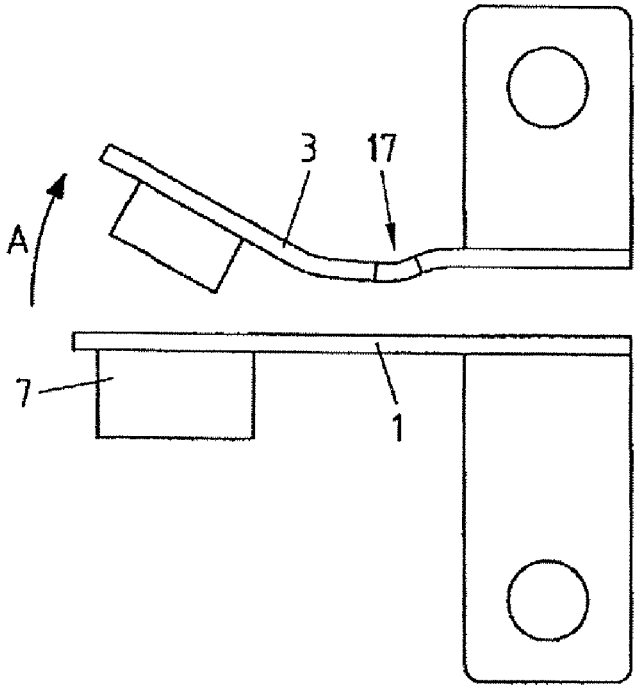
Figure 6:
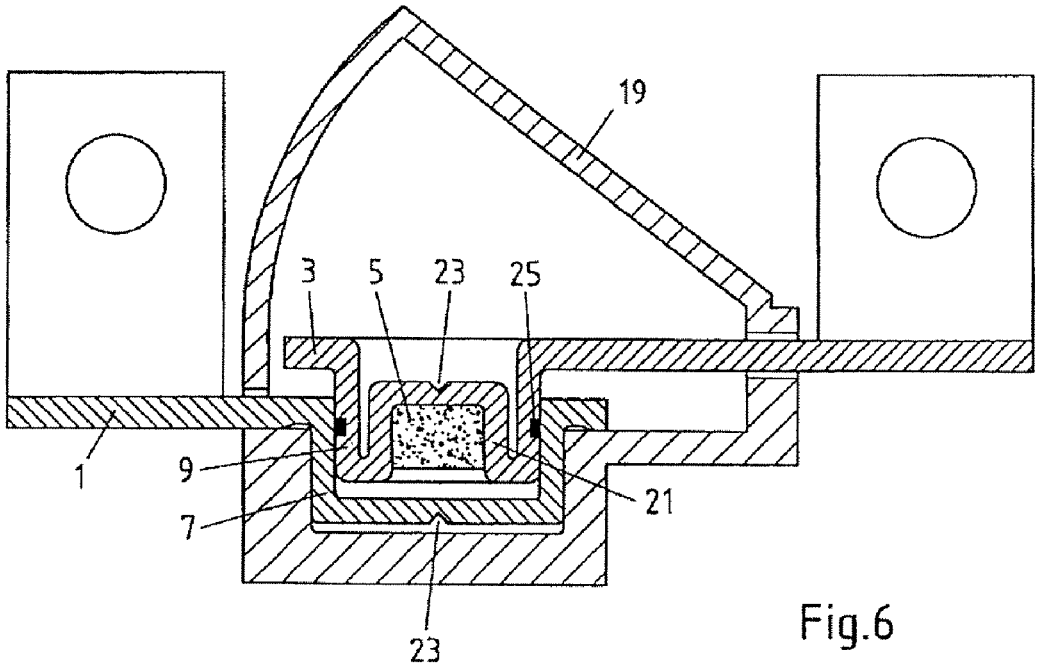
Figure 7:
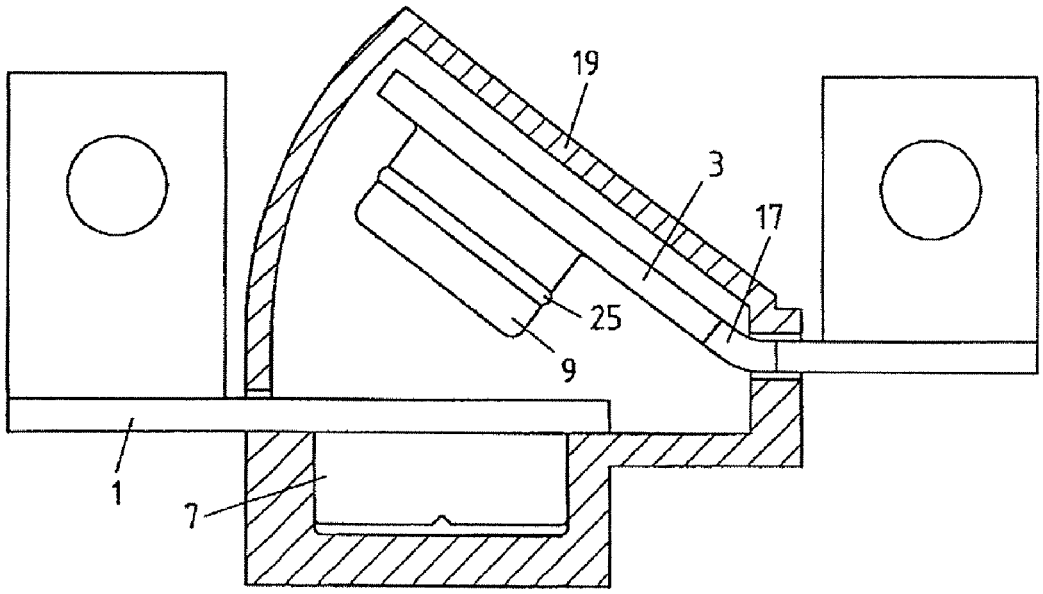
Figure 8:
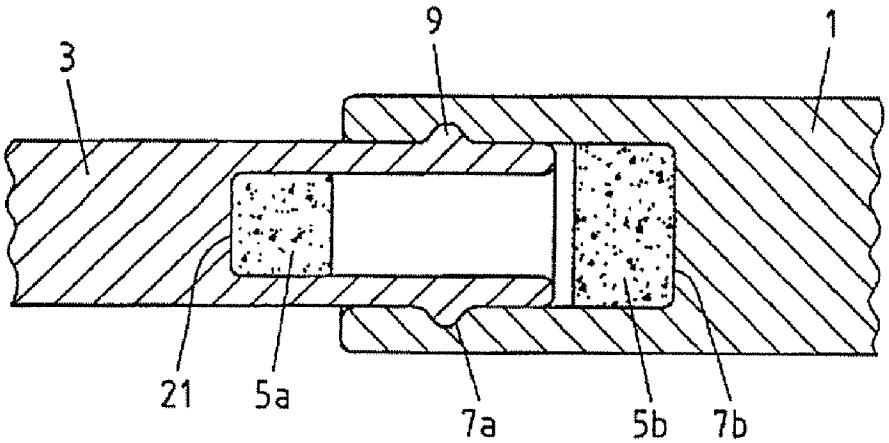
Figure 9:
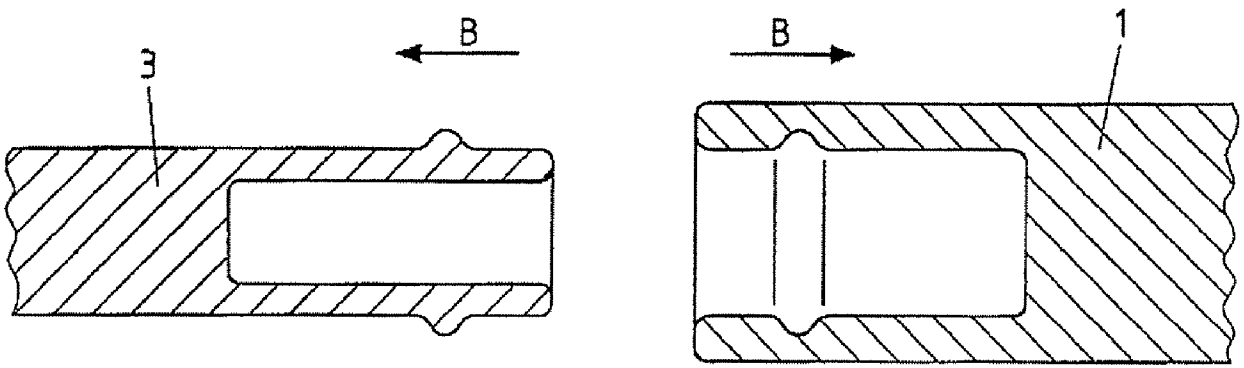
Figure 10:
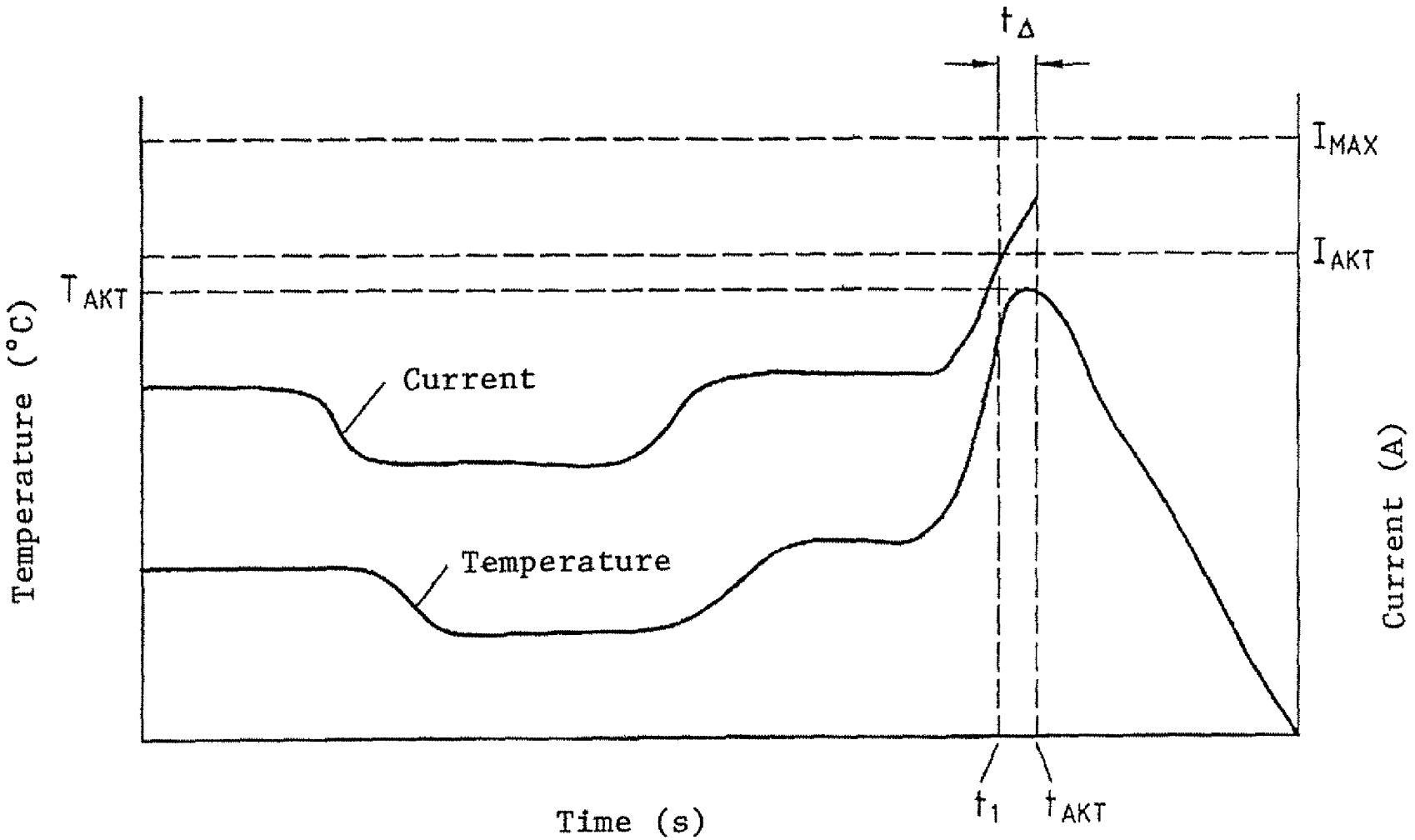

IN THE FIGURES SHOW:

FIG. 1 a circuit breaker having a single-piece first receptacle;

FIG. 2 a circuit breaker having a two-piece first receptacle;

FIG. 3 a circuit breaker having a tapered projection;

FIG. 4 a circuit breaker connected by force closure;

FIG. 5 a circuit breaker in the state in which its interengagement has been released by the pyrotechnic separating unit;

FIG. 6 an alternative embodiment having a housing;

FIG. 7 an alternative embodiment having a housing, in the state in which its interengagement has been released by the pyrotechnic separating unit;

FIG. 8 a further alternative embodiment;

FIG. 9 a further alternative embodiment, in the state in which its interengagement has been released by the pyrotechnic separating unit; and FIG. 10 a diagram of the course of the current and temperature.

FIG. 1 shows a circuit breaker for electrical supply lines, particularly power supply lines or battery cables, for motor vehicles, comprising a first connecting element 1 and a second connecting element 3, connected with the first connecting element 1 by force closure means. The state illustrated is the conducting state of the circuit breaker, wherewith a current path is established between the first connecting element 1 and second connecting element 3.

Furthermore, a pyrotechnic separating unit 5 which is thermally actuatable by Joule heat emitted by at least one of the connecting elements 1, 3 is disposed at the first connecting element 1.

Both connecting elements 1, 3 or comprised of an electrically conducting flat piece.

As shown in FIG. 1, the first connecting element 1 comprises a first receptacle 7 which is formed from the first connecting element 1 and is of unit construction therewith. In the form illustrated, the first receptacle 7 comprises a vessel structure which is formed in the first connecting element 1 by drawing. The pyrotechnic separating unit 5 is disposed in the first receptacle 7.

The second connecting element 3 comprises a projection 9 which corresponds to the first receptacle 7. When the circuit breaker is in the conducting state, the projection 9 is disposed in the first receptacle 7 by force closure. As shown in FIG. 1, the projection 9 may be formed from the flat piece of the second connecting element 3, and is of unit construction therewith. Therefore, the projection 9 may be formed by drawing from said sheet material, and, for example, may be configured as a deep-drawn structure which corresponds to the vessel structure of the first receptacle 7.

An exemplary location for installing the circuit breaker is a battery pole terminal, or a fuse box in the wiring system.

FIG. 2 illustrates a further embodiment. In contrast to the above-described exemplary embodiment, here the first receptacle 7 is comprised of two receptacle elements 11, 13. The first receptacle element 11 is formed from the first connecting element 1 and of unit construction therewith. Therefore, a part of said first connecting element has been stamped so that the first receptacle element 11 is a collar from the stamped-outing of the flat piece. The second receptacle element 13 is connected to the first receptacle element 11. This can be performed, for instance, by means of rotational friction welding. In a preliminary step, the second receptacle element 13 can be filled with the pyrotechnic separating unit 5, in particular a chemical mixture. Any other suitable method for mounting the second receptacle element 13 may be employed. It has take merely ensured that a joint having the necessary strength is produced. The second receptacle element 13 may be a prefabricated, which is mounted to the first receptacle element 11 by friction welding.

Alternatively, the first receptacle element 11 may be comprised merely of a surface in the region of the stamped-outing from the first connecting element 1. In other words, the collar may be omitted. Then, the second receptacle element 13 may fixed to said surface and to the first receptacle element 11 respectively by material bonding.

Moreover, the second receptacle element 13 may be produced from a material which comprises a different resistivity than the material of the first connecting element 1. This affords a simple means of influencing the development of the Joule heat.

FIG. 3 illustrates an alternative embodiment, wherein the projection 9 is tapered with progression away from the flat piece. This provides particularly good heat transfer from the second connecting element 3 and said projection 9 respectively to the pyrotechnic separating unit 5.

In general, the projection 9 can be formed by drawing of the flat piece during the joining of the first connecting element 1 with the second connecting element 3. This simplifies and speeds up the fabrication process. In order to achieve good force closure, after the joining the projection 9 may form a conical press fit with the first receptacle element 7.

A particularly cost-efficient fabrication can be achieved if at least one of the flat pieces is fabricated from a sheet. Preferably at least one of the flat pieces can be formed with the use of a cutting technique.

FIG. 4 shows a circuit breaker in a force closure and thus electrically closed position of the connecting elements 1, 3 prior to actuation of the pyrotechnic separating unit 5. The connecting elements 1, 3 may comprise terminals 15*a*, 15*b* formed on them for connection to battery pole terminal clamps. Said terminals 15 may be of unit construction with said connecting elements 1, 3. The terminals 15*a* may comprise bores and in addition may have support elements. The terminals 15 allow a connection to the battery pole clamps. In this way, the current path between a battery pole clamp and the network of an automobile can be protected.

The electric current path may be run from the terminal 15*a* through the first connecting element 1, the second connecting element 3, and the terminal 15*b*. In the event of an excessive current, for instance in consequence of a short circuit, the circuit breaker is heated, at least in the region of the pyrotechnic separating unit 5, such that the separating unit is ignited. The gas pressure generated by ignition of the pyrotechnic separating unit 5 cause that the projection 9 is pressed out of the first receptacle element 7, thus breaking the current path between the first connecting element 1 and the second connecting element 3. The necking 17 may be provided to facilitate the separation of the connecting elements 1, 3. The second connecting element 3 can be bent easier along the necking 17. Further, when the explosion occurs, less force is exerted on the terminal 15.

The position of the connecting elements 1, 3 resulting from the above-described events is illustrated in FIG. 5. The projection 9 of the second connecting element 3 has been forced out of the first receptacle element 7 in the direction of arrow A.

It is particularly advantageous that after releasing the pyrotechnic separating unit 5 has to be merely replaced and the second connecting element 3 has to be tolded in the direction opposite to arrow A into the first receptacle element 7. A costly and laborious repair of the circuit breaker may be omitted.

FIG. 6 is a cross sectional view of an exemplary embodiment of a circuit breaker. In addition to the above described elements, the circuit breaker comprises a catching housing 19. After the ignition of the pyrotechnic separating unit 5, a part of the second connecting element 3 is swung into said catching housing 19. The catching housing prevents the connecting element 3 from entering the engine space.

As shown in FIG. 6, a second receptacle 21 may be provided in the second connecting element 3. The pyrotechnic separating unit 5 may be arranged within the second receptacle 21. If the second receptacle 21 is combined with the projection 9, a particularly compact construction can be achieved. The first receptacle 7 can comprise a less depth. The projection 9 is arranged in the first receptacle element 7 by force closure, and the pyrotechnic separating unit 5 is disposed in the second receptacle 21 which is in turn arranged at the projection 9.

Additionally, it is shown in FIG. 6 that the first connecting element 1 and/or second connecting element 3 may comprises a notch 23. By the use of the notch 23 the electrically conducting cross section can be reduced at a advantageous location, resulting in increased Joule heating at this location. Advantageously the notches 23 or other adaptations in the component geometry are provided in the region of the pyrotechnic separating unit 5. Further, as shown in FIG. 6, an O-ring 25 may be disposed, for example, on the periphery of the projection 9. On the one hand at this location, the effect of a notch can be generated. On the other hand, the gas pressure from the pyrotechnic separating unit 5 can be particularly improved. Manufacturing tolerances which may be inherent in the fabrication process for the projection 9 and first receptacle element 7 can be compensated for by the O-ring.

FIG. 7 illustrates the circuit breaker according to FIG. 6 in a position after the actuation of the pyrotechnic separating unit 5. The second connecting element 3 has been released from the first connecting element 1, in particular without damage, and connecting element 3 has been swung out into the catching housing 19.

Another exemplary embodiment is illustrated in FIG. 8. The two connecting elements 1, 3 are both tubular. The first connecting element 1 has two receptacle configurations 7*a*, 7*b*. The first receptacle configuration 7*a* serves to accommodate and engage the projection 9 of the second connecting element 3, and thus to achieve force closure of the connecting elements 1, 3. The electrically conducting state of the device is shown in FIG. 8. The second connecting element 3 also has a receptacle configuration 21, as illustrated. Pyrotechnic separating units 5*a*, 5*b* are disposed in the receptacle configurations 7*b* and 9.

If and when the actuation temperature is reached, by Joule heating from an electric current, the pyrotechnic separating units 5*a*, 5*b* are triggered, causing the connecting elements 1, 3 to be mutually separated, in the direction of arrows B, illustrated in FIG. 9, whereby the current path is broken.

With reference to the diagram in FIG. 10, the process of breaking a current, particularly with a circuit breaker according to any of the above-described exemplary embodiments, will be described in more detail. It is noted that the courses of temperature could not be an absolute function of the current, but that the course of the temperature has always a time dependence as well.

The current remains below the actuation current $I_{AKT}$ until time $t_1$. $I_{AKT}$ should be below the maximum allowable current $I_{MAX}$ of the system being protected, for example, connecting lines or consuming loads. The electric current leads to Joule heating of the connecting elements. Thereby the pyrotechnic separating unit 5 is also heated, whereby the temperature remains below the actuation temperature $T_{AKT}$, until time $t_{AKT}$. When the current exceeds the actuation current $T_{AKT}$ at the time $t_1$ this causes a heating of the pyrotechnic separating unit until the actuation temperature $T_{AKT}$. This can be provide a small lag such that $T_{AKT}$ is reached at time $t_{AKT}$ which can be rested after time $t_1$.

At time $t_{AKT}$, the pyrotechnic separating unit 5 is ignit, whereby the force closure of the connecting elements 1, 3 is released, in particular without damage, and the electrical connection is broken.

The particular configuration of the circuit breaker which is chosen depends on the respective component being protected. This may be connecting lines and/or consuming loads. The important consideration is that the pyrotechnic separating unit in combination with the connecting elements is selected such that the pyrotechnic separating unit 5 ignites reliably before the maximum allowable current $I_{MAX}$ is reached. Advantageously, the circuit breaker is configured such that the time interval $t_\Delta$ between $t_1$ and $t_{AKT}$ ($\Delta t = t_{AKT} - t_1$) is as short as possible. This can be achieved in particular by the choice of special materials for the connecting elements, special configurations of the notches, and of the receptacles and the projection 9 as well.

The inventive circuit breaker, according to the application, is distinguished by the fact that it is easy and inexpensive to manufacture. Further, after the pyrotechnic separating unit 5 is actuated, the circuit breaker can be reassembled such that a replacement of components can be omitted.

The application includes also connecting elements which are formed as connecting rails, and which can break, for example, a plurality of conduction paths. Thus a connecting rail, similar to a comb, may be provided. Each tooth of the comb itself may comprise pyrotechnic separating unit and may break the current path to a further connecting element, as described above. In particular, the individual teeth may have different configurations such that the individual current paths can be broken at different values of the electric current.

The invention claimed is:

1. A circuit breaker for electrical supply lines, particularly power supply lines or battery cables, for motor vehicles, comprising:

a first electrical connecting element having a first receptacle;

a second electrical connecting element press fit into the first receptacle whereby a current path is established between the connecting elements such that in a conducting state of the circuit breaker an electric current passes between the first electrical connecting element and the second electrical connecting element; and a pyrotechnic separating unit disposed in the first receptacle in a region between the first and second electrical connecting elements, the pyrotechnic separating unit thermally actuatable by Joule heat created by the electric current flowing between the electrical connecting elements and emitted by at least one of the electrical connecting elements, the pyrotechnic separating unit actuatable to displace at least a portion of at least one electrical connecting element with respect to the other via pressure generated by the actuated pyrotechnic separating unit and exerted on the connecting elements, whereby the current path between the electrical connecting elements is broken.

2. The circuit breaker of claim 1, wherein the first connecting element is connected to the second connecting element by material bonding.

3. The circuit breaker of claim 1, wherein the first connecting element is comprised of an electrically conducting flat piece.

4. The circuit breaker of claim 1, wherein the first receptacle is formed from the first connecting element and is of unit construction therewith.

5. The circuit breaker of claim 1, wherein the first receptacle comprises a vessel structure which is formed in the first connecting element by drawing.

6. The circuit breaker of claim 1, wherein the first receptacle is comprised of at least two receptacle elements.

7. The circuit breaker of claim 1, wherein the first receptacle comprises a collar around a stamped-out opening in an electrically conducting flat piece.

8. The circuit breaker of claim 7, wherein the second connecting element comprises an electrically conducting flat piece.

9. A circuit breaker of claim 8, wherein at least one of the flat pieces is fabricated from a metallic sheet or plate by means of a cutting or press-forming technique.

10. The circuit breaker of claim 7, wherein the second connecting element comprises a projection which corresponds to the first receptacle, wherein when the circuit breaker is in the conducting state, the projection is disposed in the first receptacle by the press fit such that the interconnection between the connecting elements is releasable via pressure generated by the actuated pyrotechnic separating unit.

11. The circuit breaker of claim 10, wherein the projection is formed from the flat piece and is of unit construction therewith.

12. The circuit breaker of claim 10, wherein the projection is formed from the flat piece by drawing.

13. The circuit breaker of claim 10, wherein the projection is a deep-drawn vessel structure which corresponds to the first receptacle.

14. The circuit breaker of claim 10, wherein the projection is tapered with progression away from the flat piece.

15. The circuit breaker of claim 10, wherein the projection is formed from the flat piece by drawing, while the first connecting element is being joined to the second connecting element.

16. A circuit breaker of claim 10, wherein the projection forms a conical press fit with the first receptacle after joining.

17. The circuit breaker of claim 1 wherein the second connecting element comprises a second receptacle.

18. The circuit breaker of claim 17, wherein the second receptacle is press fit into the first receptacle.

19. The circuit breaker of claim 17, wherein the pyrotechnic separating unit is disposed in at least one of the receptacles.

20. A circuit breaker of claim 1, wherein at least one of the connecting elements has a notch that increases the ohmic resistance.

21. A circuit breaker of claim 1, wherein the actuating current needed to reach the actuating temperature of the pyrotechnic separating unit by generation of Joule heat is less than or equal to the maximum allowable current in the lines and/or cables and/or consuming devices connected to the connecting elements.

22. A method of breaking a circuit, comprising:

passing an actuating current through first and second electrical connecting elements of a circuit breaker, the second connecting element being press fit into a receptacle of the first connecting element to establish a current path between the connected connecting elements, the press fit of the connecting elements being releasable via pressure generated by thermal actuation of a pyrotechnic separating unit disposed in a region between the second electrical connecting element and the receptacle of the first connecting element;

heating at least one of the electrical connecting elements to the actuating temperature by Joule heat generated by the actuating current flowing through the electrical connecting elements; and actuating, via the Joule heat, the pyrotechnic separating unit to displace at least a portion of at least one electrical connecting element with respect to the other via pressure generated by the actuated pyrotechnic separating unit and exerted on the connecting elements, whereby the press fit is released and the current path between the electrical connecting elements is broken.

* * * * *